US007959266B2

(12) United States Patent
Andrews et al.

(10) Patent No.: US 7,959,266 B2
(45) Date of Patent: Jun. 14, 2011

(54) SELF ALIGNED PORT HOLE OPENING PROCESS FOR INK JET PRINT HEADS

(75) Inventors: John Richard Andrews, Fairport, NY (US); Pinyen Lin, Rochester, NY (US); David Gervasi, Pittsford, NY (US); Bradley J. Gerner, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1112 days.

(21) Appl. No.: 11/692,616

(22) Filed: Mar. 28, 2007

(65) Prior Publication Data

US 2008/0239022 A1 Oct. 2, 2008

(51) Int. Cl.
*B41J 2/045* (2006.01)

(52) U.S. Cl. ..... 347/71

(58) Field of Classification Search ..... 347/68, 347/69, 70, 71, 72; 400/124.14, 124.16, 400/311, 324, 327
See application file for complete search history.

(56) References Cited

U.S. PATENT DOCUMENTS

| | | | |
|---|---|---|---|
| 2002/0149652 | A1 | 10/2002 | Sakamoto et al. |
| 2003/0058310 | A1 | 3/2003 | Murai |
| 2004/0104977 | A1 | 6/2004 | Mitsuhashi et al. |
| 2006/0066693 | A1 | 3/2006 | Koike et al. |
| 2006/0209139 | A1 | 9/2006 | Murata |

FOREIGN PATENT DOCUMENTS

JP 2001088303 4/2001

*Primary Examiner* — K. Feggins
(74) *Attorney, Agent, or Firm* — MH2 Technology Law Group LLP

(57) ABSTRACT

In accordance with the invention, there are jet stacks, ink jet print heads, and methods of making jet stacks and ink jet print heads. The method of making an ink jet print head can include providing a partial jet stack including a diaphragm, a plurality of port holes, and having an ink outlet side and providing a polymer planarized piezoelectric array. The method can also include bonding the polymer planarized piezoelectric array to a side opposite to the ink outlet side of the partial jet stack using an adhesive, wherein the partial jet stack is aligned such that the planarized polymer covers the plurality of port holes, and using the partial jet stack as a mask to extend the port holes through the polymer by ablating the polymer and an excess portion of the adhesive from the ink outlet side using a laser.

17 Claims, 10 Drawing Sheets

SELF ALIGNED PORT HOLE OPENING PROCESS FOR INK JET PRINT HEADS

FIELD OF THE INVENTION

The subject matter of this invention relates to ink jet printing devices. More particularly, the subject matter of this invention relates to high density piezoelectric ink jet print heads and methods of making a high density piezoelectric ink jet print heads.

BACKGROUND OF THE INVENTION

Drop on demand ink jet technology is widely used in the printing industry. Drop on demand ink jet printers use either thermal or piezoelectric technology. A piezoelectric ink jet has an advantage over a thermal ink jet in that wider variety of inks can be used. It is desirable to increase the printing resolution of an ink jet printer employing piezoelectric ink jet technology. To increase the jet density of the piezoelectric ink jet print head, one can eliminate manifolds internal to the jet stack. It is further desirable to have a single port through the back of the jet stack for each jet. However, this implies that the large number of ports must pass vertically through the diaphragm and between the piezoelectric actuators for neighboring jets. To enable clean open port holes that can be sealed ink passages requires a significant different design and assembly processes than what is used currently.

Thus, there is a need to overcome these and other problems of the prior art to provide a system and method of forming a high jet density in piezoelectric ink jet print head.

SUMMARY OF THE INVENTION

In accordance with the invention, there is a method of making an ink jet print head. The method can include providing a partial jet stack including a plurality of port holes and having an ink outlet side and providing a piezoelectric array including a plurality of piezoelectric elements disposed in a planarized polymer. The method can further include bonding the piezoelectric array to a side opposite to the ink outlet side of the partial jet stack, wherein the partial jet stack is aligned such that the planarized polymer covers the plurality of port holes and using the partial jet stack as a mask to extend the port holes through the planarized polymer by ablating the planarized polymer from the ink outlet side using a laser.

According to various embodiments of the present teachings, there is a method of making a jet stack. The method can include providing a partial jet stack including a diaphragm, a plurality of port holes, a plurality of inlet channels, a first plurality of outlet apertures, and having an ink outlet side and providing a piezoelectric array on a carrier including a plurality of piezoelectric elements and a plurality of kerfed regions. The method can also include depositing a polymer in the kerfed regions, planarizing the polymer in the kerfed regions to form a polymer planarized piezoelectric array, and bonding the polymer planarized piezoelectric array to a side opposite to the ink outlet side of the partial jet stack using an adhesive, wherein the partial jet stack is aligned such that the planarized polymer covers the plurality of port holes. The method can further include using the partial jet stack as a mask to extend the port holes through the polymer by ablating the polymer and an excess portion of the adhesive from the ink outlet side using a laser.

According to yet another embodiment of the present teachings, there is a jet stack. The jet stack can include a partial jet stack including a diaphragm having an ink outlet side, a body plate disposed under the ink outlet side of the diaphragm, and an inlet plate including a plurality of inlet channels and a first plurality of outlet apertures disposed under the body plate, wherein the diaphragm includes a plurality of port holes. The jet stack can also include a piezoelectric array including a plurality of piezoelectric elements disposed in a planarized polymer bonded to a side opposite to the ink outlet side of the diaphragm such that the planarized polymer covers the plurality of port holes.

According to another embodiment of the present teachings, there is an ink jet print head. The ink jet print head can include a partial jet stack including a diaphragm having an ink outlet side, a body plate disposed under the ink outlet side of the diaphragm, and an inlet plate including a plurality of inlet channels and a first plurality of outlet apertures disposed under the body plate, wherein the diaphragm includes a plurality of port holes. The ink jet print head can also include a piezoelectric array including a plurality of piezoelectric elements disposed in a planarized polymer bonded to a side opposite to the ink outlet side of the diaphragm such that the planarized polymer covers the plurality of port holes. The ink jet print head can also include an aperture plate including a second plurality of outlet apertures bonded to the inlet plate of the partial jet stack, wherein the second plurality of outlet apertures are substantially aligned with the first plurality of outlet apertures. The ink jet print head can further include a circuit board including a plurality of vias and a plurality of contact pads bonded to the piezoelectric array with a standoff layer, wherein the standoff layer provides a fluid seal between the circuit board and the plurality of port holes and an ink manifold, wherein each of the plurality of vias and each of the plurality of port holes provide an individual inlet connecting the ink manifold with each of the second plurality of outlet apertures.

According to yet another embodiment of the present teachings, there is a printing apparatus. The printing apparatus can include a partial jet stack including a diaphragm having an ink outlet side, a body plate disposed under the ink outlet side of the diaphragm, and an inlet plate including a plurality of inlet channels and a first plurality of outlet apertures disposed under the body plate, wherein the diaphragm includes a plurality of port holes. The printing apparatus can also include a piezoelectric array including a plurality of piezoelectric elements disposed in a planarized polymer bonded to a side opposite to the ink outlet side of the diaphragm such that the planarized polymer covers the plurality of port holes. The printing apparatus can further include an aperture plate including a second plurality of outlet apertures bonded to the inlet plate of the partial jet stack, wherein the second plurality of outlet apertures are substantially aligned with the first plurality of outlet apertures. The printing apparatus can further include a circuit board including a plurality of vias and a plurality of contact pads bonded to the piezoelectric array with a standoff layer, wherein the standoff layer provides a fluid seal between the circuit board and the plurality of port holes and an ink manifold, wherein each of the plurality of vias and each of the plurality of port holes provide an individual inlet connecting the ink manifold with each of the second plurality of outlet apertures.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1A:
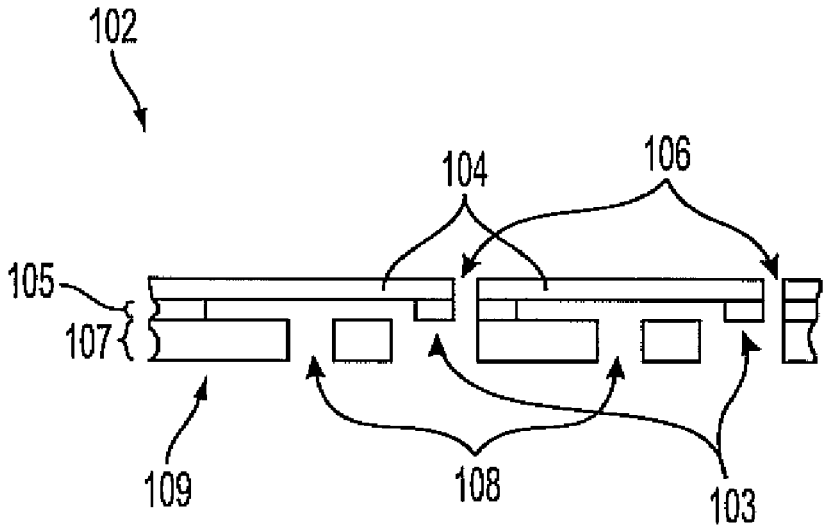
FIGS. 1A-1I illustrate an exemplary method of making an ink jet print head according to various embodiments of the present invention.

According to various embodiments of the present teachings, there is an exemplary method of making an ink jet print head 100 as shown in FIGS. 1A-1I. The method of making an ink jet print head 100 can include providing a partial jet stack 102 including a plurality of port holes 106 and having an ink outlet side 109 as shown in FIG. 1A. In various embodiments, the partial jet stack 102 as shown in FIG. 1A can include a diaphragm 104, a body plate 105 disposed under the diaphragm 104, and an inlet plate 107 including a plurality of inlet channels 103 and a first plurality of outlet apertures 108 disposed under the body plate 105, wherein the plurality of port holes 106 includes a passageway through the diaphragm 104, the body plate 105, and the inlet plate 107. In some embodiments, the partial jet stack 102 can include a brazed three layer stainless steel structure including the diaphragm 104, the body plate 105, and the inlet plate 107. In other embodiments, the partial jet stack 102 can include port holes 106 formed, for example, by chemical etching.

Figure 1B:
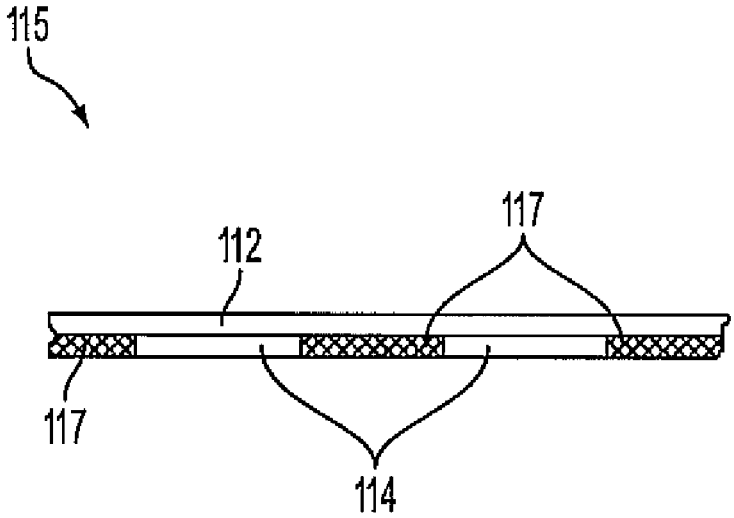

The method of making an ink jet print head 100 can also include providing a piezoelectric array 115 including a plurality of piezoelectric elements 114 disposed in a planarized polymer 117 as shown in FIG. 1B. In some embodiments, the piezoelectric array 115 can include piezoelectric material selected from a group consisting of lead zirconate titanate (PZT), barium titanate, lead titanate, lead magnesium niobate (PMN), lead nickel niobate (PNN), and lead zinc niobate. In various embodiments, the piezoelectric array 115 can include planarized polymer 117 selected from the group consisting of thermoset and thermoplastic polymers. In other embodiments, the planarized polymer 117 can be selected from at least one of epoxy, polyimide, and silicone. In some embodiments, the planarized polymer 117 can have a tensile modulus less than about 2 GPa at about 120° C. In some embodiments, the piezoelectric elements 114 and the planarized polymer 117 can have a thickness from about 10 μm to about 100 μm. In various embodiments, the step of providing a piezoelectric array 115 can further include providing the plurality of piezoelectric elements 114 disposed in an array on a carrier 112, as shown in FIG. 1B. The carrier 112 can be a metal support layer including one or more of a pressure sensitive adhesive and a releasable adhesive to hold the piezoelectric elements 114 to the carrier. In various embodiments, the step of providing the piezoelectric array 115 can include providing a piezoelectric sheet bonded to a carrier 112, cutting or slicing the piezoelectric sheet to form a plurality of kerfed regions 216, as shown in FIG. 2B, filling the kerfed regions 216 with a polymer, and planarizing the polymer in the kerfed region to form a plurality of piezoelectric elements 114 disposed in a planarized polymer 117 as shown in FIGS. 1B and 2C. In some embodiments, the step of providing the piezoelectric array 115 can include transferring one or more pre-formed piezoelectric elements 114 onto the carrier 112 and planarizing the pre-formed piezoelectric elements 114 over the carrier with a polymer 117.

Figure 1C:
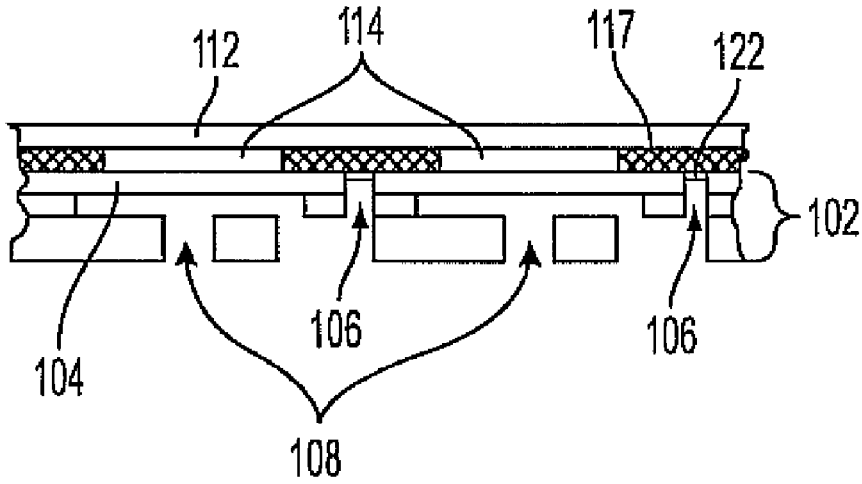

The method of making an ink jet print head 100 can further include bonding the piezoelectric array 115 to a side opposite to the ink outlet side 109 of the partial jet stack 102, wherein the partial jet stack 102 can be aligned such that the planarized polymer 117 can cover the plurality of port holes 106 as shown in FIG. 1C. In various embodiments, the bonding of the piezoelectric array 115 to the partial jet stack 102 can done using an adhesive 122 including but not limited to, for example epoxy, silicone, and bismaleimide. In some embodiments, the adhesive 122 can be dispensed on the partial jet stack 102. In other embodiments, the adhesive 122 can be dispensed on the piezoelectric array 115. In some other embodiments, a thin layer of transfer adhesive can be used. Yet in other embodiments, a bead of adhesive can be used. The step of bonding the piezoelectric array 115 to the partial jet stack 102 can also include thermal curing at a temperature in the range of about 100° C. to about 250° C. In some embodiments, the carrier 112 can be removed from the piezoelectric array 115 after the step of bonding the piezoelectric array 115 to the partial jet stack 102.

Figure 1D:
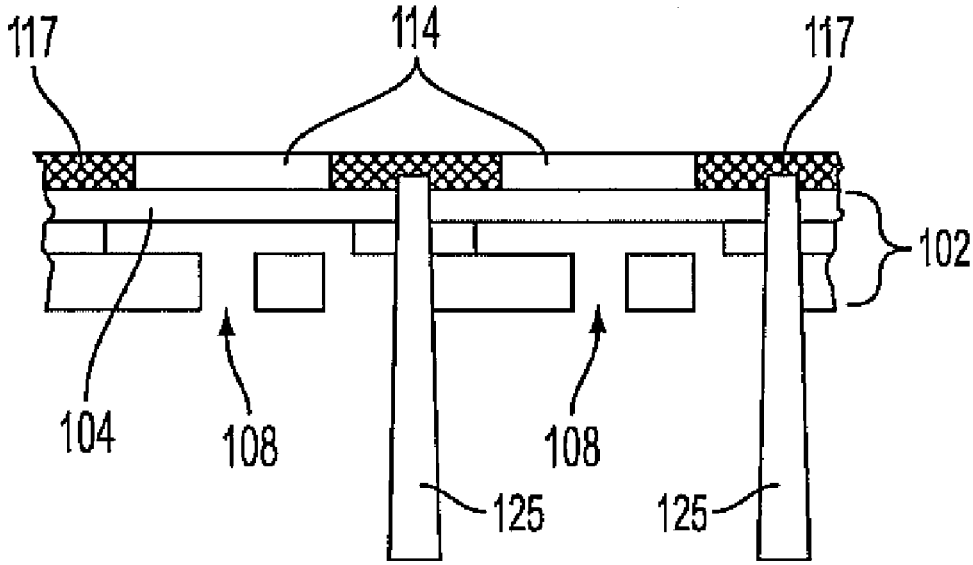
Figure 1E:
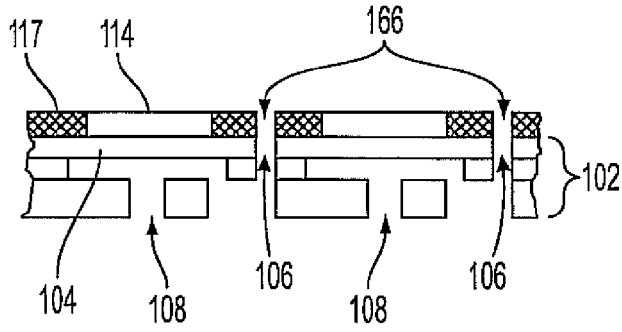
Figure 1F:
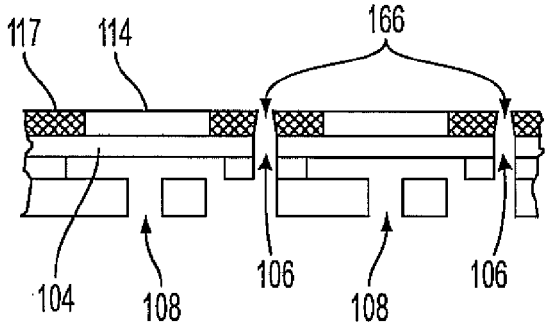

The method of making an ink jet print head 100 can also include using the partial jet stack 102 as a mask to extend the port holes 106 through the planarized polymer 117 by ablating the planarized polymer 117 from the ink outlet side 109 using a laser 125, as shown in FIG. 1D. In some embodiments, the extended port hole 166 through the planarized polymer 117 formed by laser ablation can have a uniform cross-section as shown in FIG. 1E. In other embodiments, the extended port hole 166 through the planarized polymer 117 formed by laser ablation can have a tapered cross-section as shown in FIG. 1F.

Several parameters for laser ablation such as wavelength of the laser, laser pulse duration, repetition rate, laser power depends on a number of factors including polymer's optical properties and thickness of the polymer to be ablated. However, one of ordinary skill in the art can determine them. In various embodiments, ablating the planarized polymer 117 from the ink outlet side 109 can include using at least one of a $CO_2$ laser, an excimer laser, a solid state laser, a copper vapor laser, and a fiber laser. One of ordinary skill in the art would know that the $CO_2$ laser and the excimer laser can typically ablate polymers including epoxies. The $CO_2$ laser can have a low operating cost and can be ideal for high volume production. The $CO_2$ laser beam that can over-fill the mask could sequentially illuminate each port hole 106 to form the extended port holes 166 through the polymer 117 and remove an excess portion of the adhesive 122 that flows into the port hole 106 from the bonding of the piezoelectric array 115 to the partial jet stack 102, as shown in FIGS. 1E and 1F. Furthermore, one of ordinary skill in the art would also know that the excimer laser can be used to flood illuminate or can be used with special optics to illuminate each of the port holes 106 to form the extended port holes 166 though the polymer 117 and remove an excess portion of the adhesive 122 from the bonding of the piezoelectric array 115 to the partial jet stack 102, as shown in FIGS. 1E and 1F.

Figure 1G:
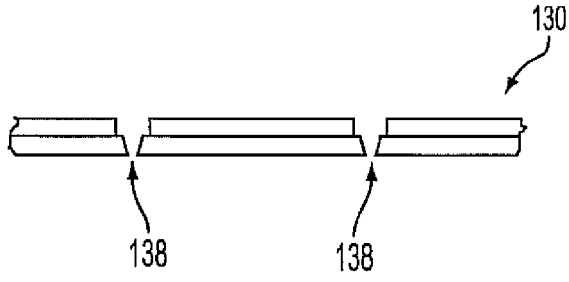
Figure 1H:
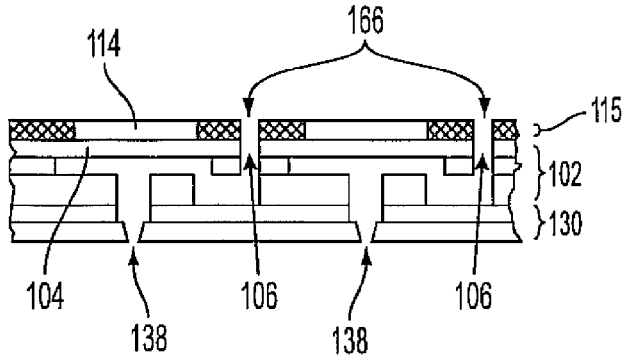

The method of making an ink jet print head 100 can further include bonding an aperture plate 130 as shown in FIG. 1G including a second plurality of outlet apertures 138 to the ink outlet side 109 of the partial jet stack 102, wherein the second plurality of outlet apertures 138 are substantially aligned with the first plurality of outlet apertures 108 as shown in FIG. 1H. In various embodiments, an adhesive such as a thermoplastic polyimide can be used in bonding the aperture plate 130 to the partial jet stack 102. In some embodiments, a b-staged epoxy can used in bonding the aperture plate 130 to the partial jet stack 102. In some other embodiments, the aperture plate 130 can include a single layer or a two layer metal structure. Yet, in other embodiments, the aperture plate 130 can be formed of stainless steel. In various embodiments, the aperture plate 130 can include a polymeric plate wherein the second plurality of outlet apertures 138 can be formed by laser ablation. In some embodiments, the aperture plate 130 can include polymers such as polyimide, polyetherimide, polysulfone, polyetherketone, polyphenylene sulfide, and polyester. In various embodiments, the method of making an ink jet print head 100 can further include bonding filters, manifolds, other jet stack design elements to the partial jet stack 102, circuit board 140, and flexible circuit substrates. In some embodiments, the method of making an ink jet print head 100 can also include cleaning the extended port holes 166 through the planarized polymer 117 and the passageway through the diaphragm 104, the body plate 105, and the inlet plate 107 prior to bonding the aperture plate 130 to the ink outlet side of the partial jet stack 102. The disclosed method of making an ink jet print head 100 permits cleaning of the extended port holes 166 to remove any debris formed as a result of the laser ablation of the polymer as the port holes 106, 166 are accessible from both sides, the ink outlet side 109 and the side opposite to the ink outlet side. In various embodiments, each of the second plurality of outlet apertures 138 can be smaller in size compared to the first plurality of outlet apertures 108. In other embodiments, each of the second plurality of outlet apertures 138 can further include nozzle for dispensing ink.

Figure 1I:
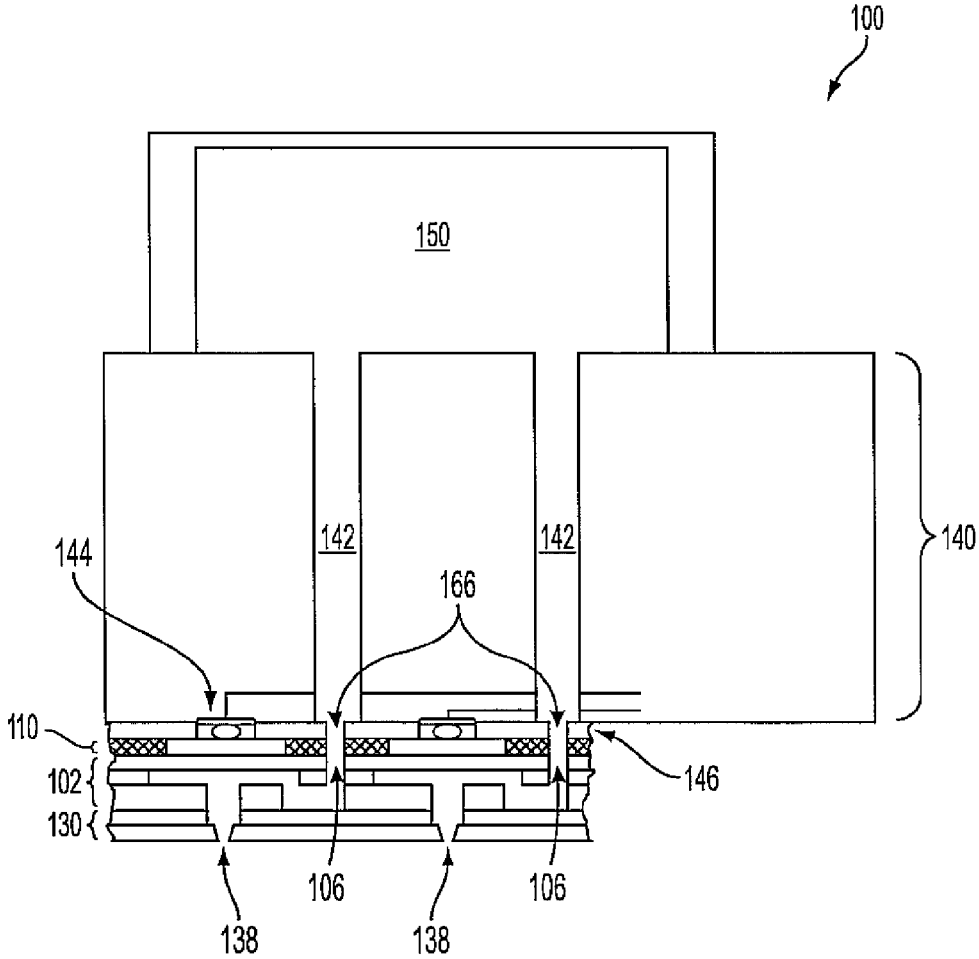

In various embodiments, the method of making an ink jet print head 100 can also include bonding a standoff layer 146 to the piezoelectric array 115 before the step of using the partial jet stack 102 as a mask to extend the port holes 106 through the planarized polymer 117 by ablating the planarized polymer 117 from the ink outlet side 109 using a laser 125 and extending the port holes 106 through the standoff layer 146 during the step of using the partial jet stack 102 as a mask to extend the port holes 106 through the planarized polymer 117 by ablating the planarized polymer 117 and the standoff layer 146 from the ink outlet side 109 using a laser 125. In some embodiments, the standoff layer 146 can include acrylic polymer. In other embodiments, the standoff layer 146 can include silicone. In certain embodiments, the standoff layer 146 can be precut having an adhesive portion that can be aligned and bonded with heat treatment. In some embodiments, the method of making an ink jet print head 100 can further include bonding a circuit board 140 including a plurality of vias 142 and a plurality of contact pads 144 to the piezoelectric array 115 using a standoff layer 146, wherein the standoff layer 146 provides a fluid seal between the circuit board 140 and the plurality of port holes 106 and providing an ink manifold 150, wherein each of the plurality of vias 142 and each of the plurality of port holes 106 provide an individual inlet connecting the ink manifold 150 with each of the second plurality of outlet apertures 138, as shown in FIG. 1I.

Figure 2A:
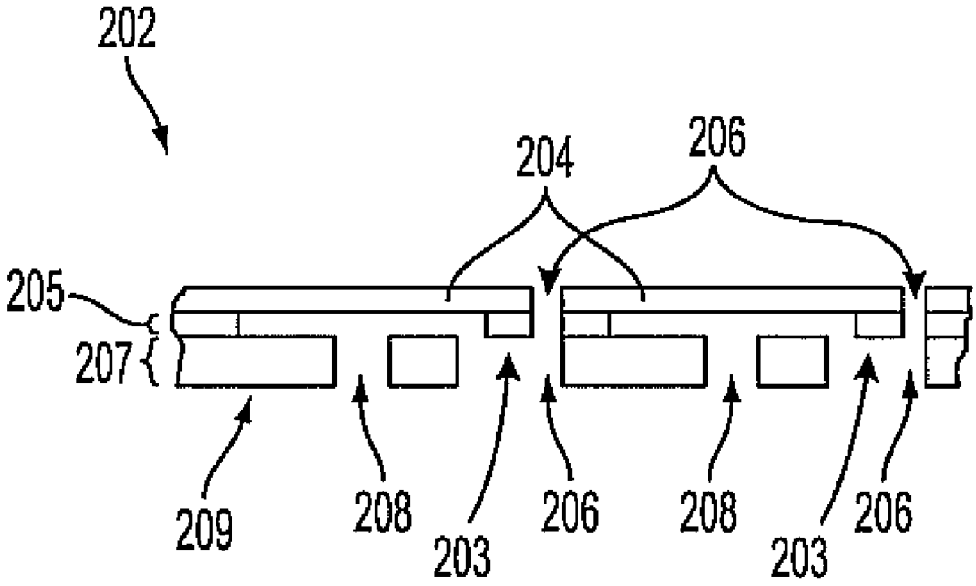
FIGS. 2A-2H illustrate an exemplary method of making a jet stack according to various embodiments of the present teachings.
Figure 2B:
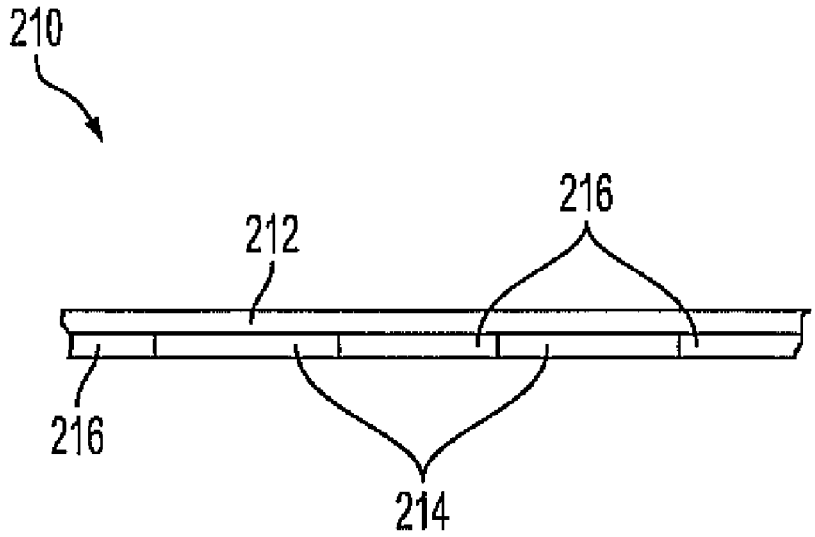
Figure 2C:
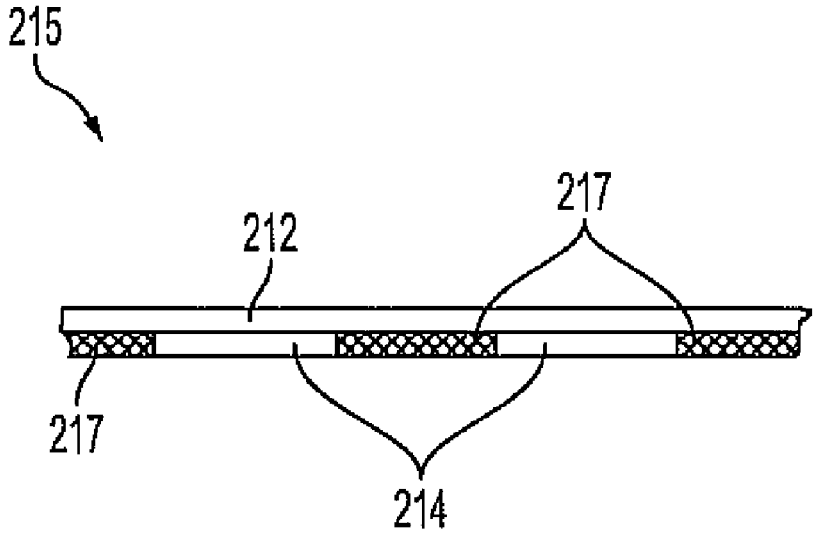
Figure 2D:
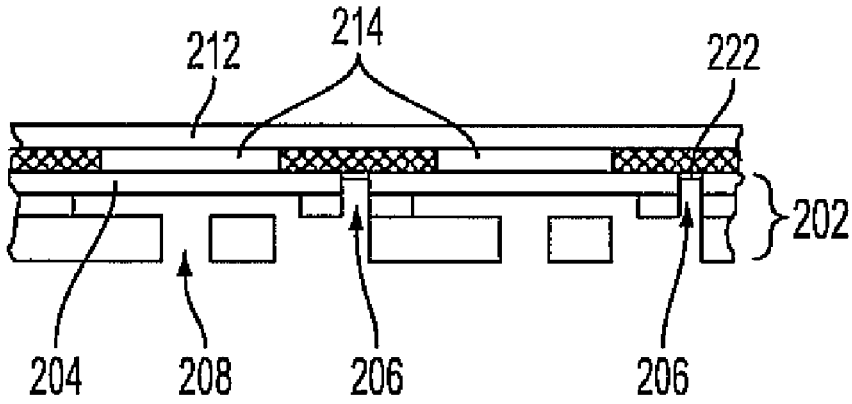
Figure 2E:
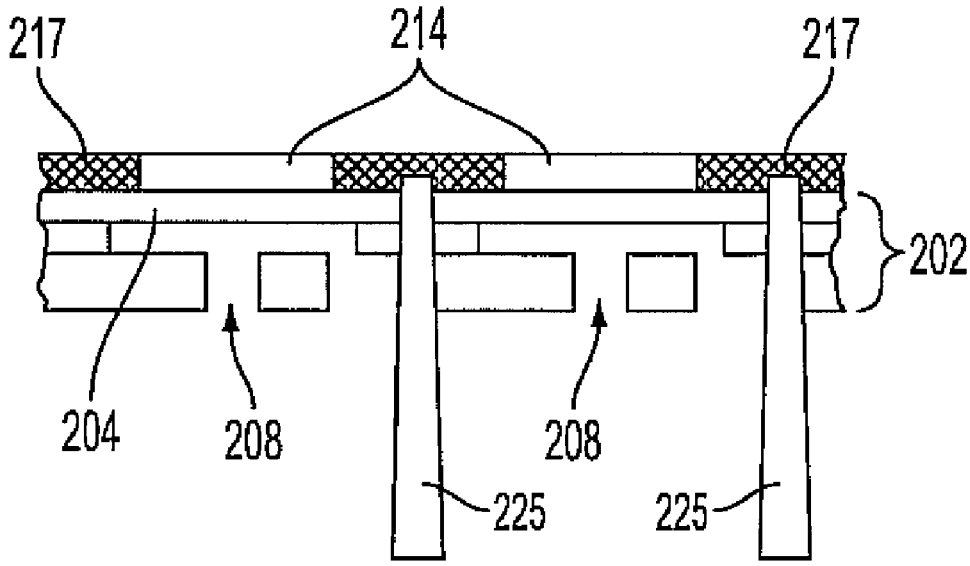
Figure 2F:
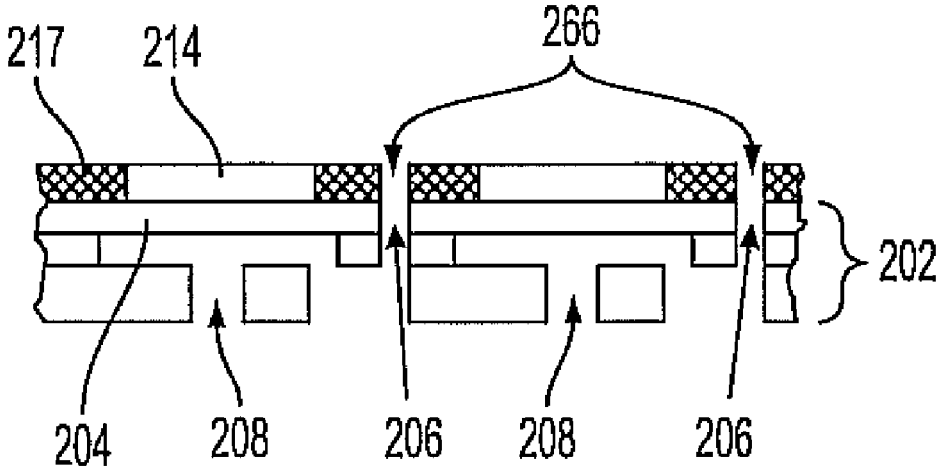
Figure 2G:
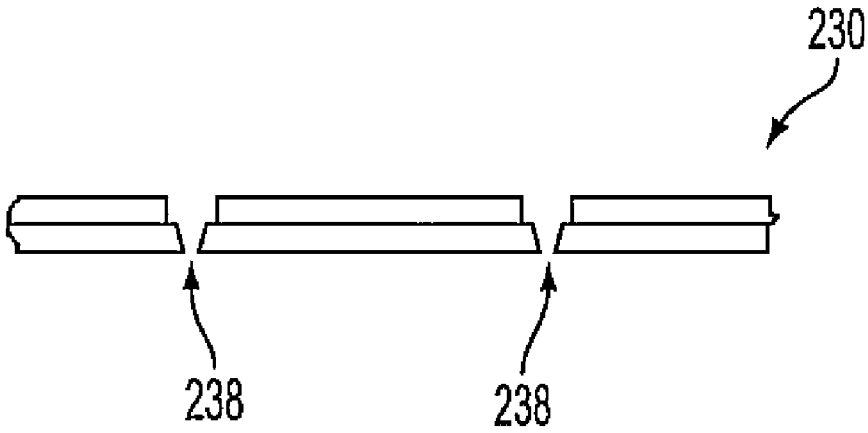
Figure 2H:
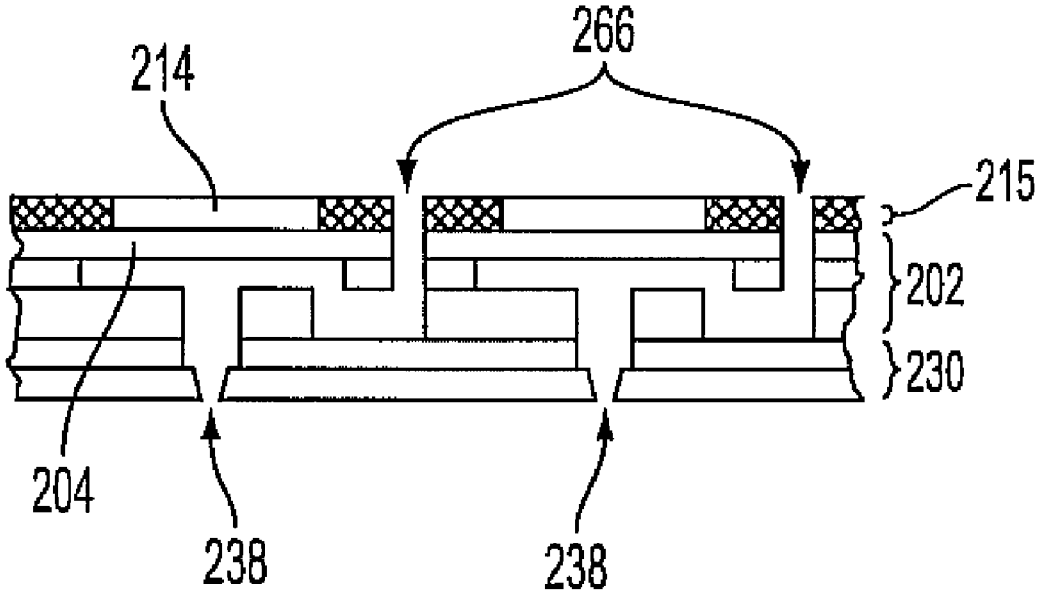

According to various embodiments, there is a method of making a jet stack 200 as shown in FIGS. 2A-2H. The method of making a jet stack 200 can include providing a partial jet stack 202 including a diaphragm 204, a plurality of port holes 206, a plurality of inlet channels and a first plurality of out let apertures 208, and having an ink outlet side 209, as shown in FIG. 2A. The method of making a jet stack 200 can also include providing a piezoelectric array 210 on a carrier 212 including a plurality of piezoelectric elements 214 and a plurality of kerfed regions 216, as shown in FIG. 2B. In various embodiments, each of the kerfed regions can be wide enough to accommodate the port holes 106. In some embodiments, each of the kerfed regions can have width in the range of about 100 μm to about 400 μm. The method of making a jet stack 200 can further include depositing a polymer 217 in the kerfed regions 116 and planarizing the polymer 217 in the kerfed regions 216 to form a polymer planarized piezoelectric array 215, as shown in FIG. 2C. In some embodiments, the kerfed regions 216 can be filled with a prepolymer liquid or paste, which can then be polymerized. The method of making a jet stack 200 can also include bonding the polymer planarized piezoelectric array 215 to a side opposite to the ink outlet side 209 of the partial jet stack 202 using an adhesive 222, wherein the partial jet stack 202 is aligned such that the planarized polymer 217 covers the plurality of port holes 206, as shown in FIG. 2D. In some embodiments, the adhesive 222 forms a thin layer between the partial jet stack 202 and the polymer planarized piezoelectric array 215, with an excess portion of the adhesive 222 flowing into the port hole 206 from the bonding of the piezoelectric array 215 to the partial jet stack 202. The method of making a jet stack 200 can further include using the partial jet stack 202 as a mask to extend the port holes 206 through the polymer 217 by ablating the polymer 217 and an excess portion of the adhesive 222 from the ink outlet side 209 using a laser 225, as shown in FIG. 2E. In some embodiments, the step of ablating the planarized polymer 217 from the ink outlet side 209 can include using at least one of a $CO_2$ laser, an excimer laser, a solid state laser, a copper vapor laser, and a fiber laser. In various embodiments, the method of making a jet stack 200 can include the providing a partial jet stack 202 including four layers or less. The method of making a jet stack 200 can also include cleaning the extended port holes 266 through the planarized polymer 217 to remove any debris from the ablation of the planarized polymer 217 and the adhesive, as shown in FIG. 2G and bonding an aperture plate 230 as shown in FIG. 2G including a second plurality of outlet apertures 238 to the ink outlet side 209 of the partial jet stack 202 as shown in FIG. 2H, wherein the second plurality of outlet apertures 238 can be substantially aligned with the first plurality of outlet apertures 208.

Figure 3:
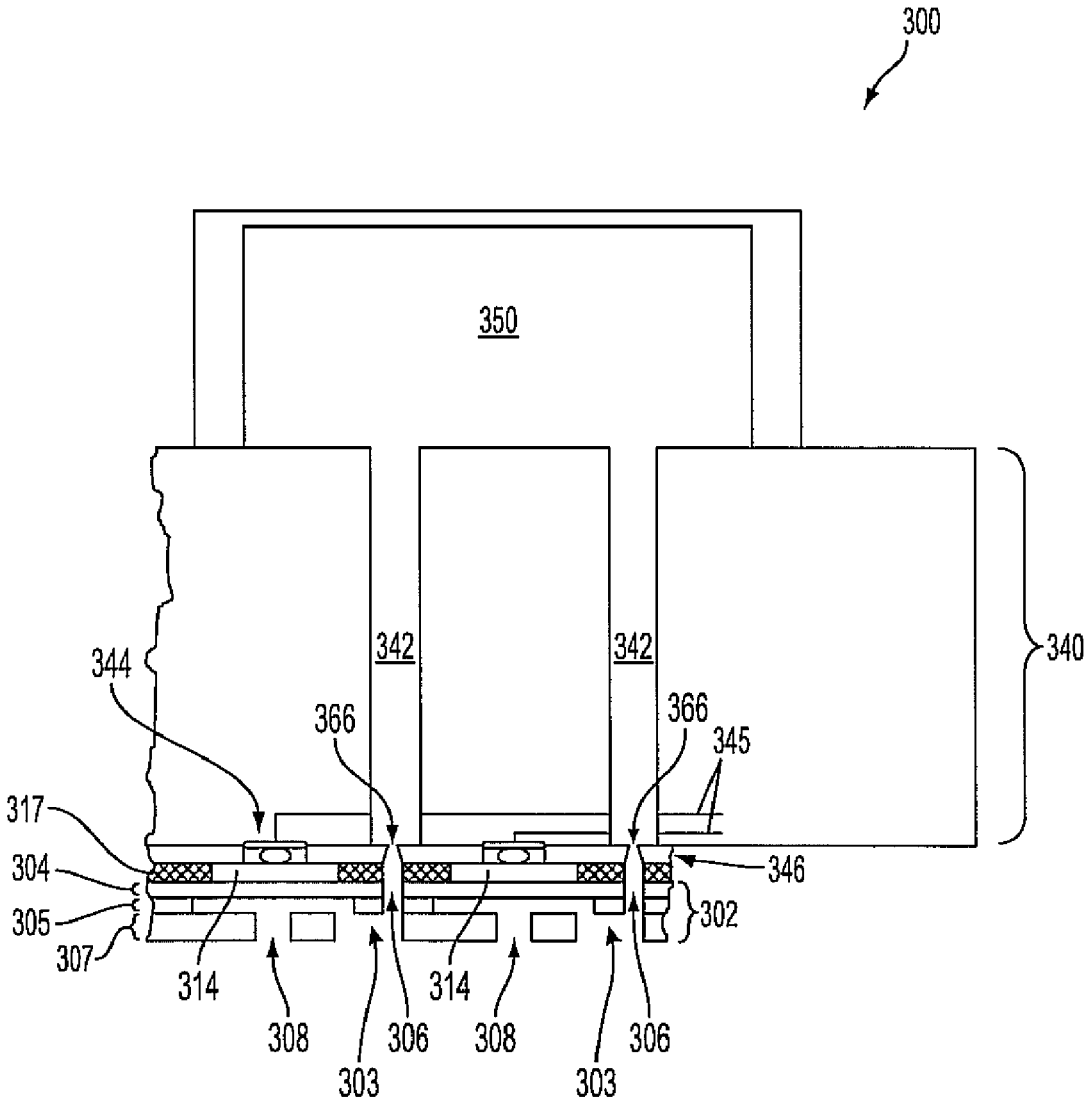
FIG. 3 illustrates an exemplary ink jet print head according to various embodiments of the present teachings.

FIG. 3 shows a schematic illustration of an exemplary ink jet print head 300. The ink jet print head 300 can include a partial jet stack 302 including a diaphragm 304 having an ink outlet side, a body plate 305 disposed under the ink outlet side of the diaphragm 304, and an inlet plate 307 including a plurality of inlet channels 303 and a first plurality of outlet apertures 308 disposed under the body plate 305, wherein the diaphragm 304 includes a plurality of port holes 306. The ink jet print head 300 can also include a piezoelectric array 315 including a plurality of piezoelectric elements 314 disposed in a planarized polymer 317 bonded to a side opposite to the ink outlet side of the diaphragm 304 such that the planarized polymer 317 covers the plurality of port holes 306. In some embodiments, the ink jet print head 300 can include a laser ablated hole 366 extending each of the plurality of port holes 306 through the planarized polymer 317. In some other embodiments, the laser ablated hole 366 can include a tapered cross section. In various embodiments, the ink jet print head 300 can further include an aperture plate 330 including a second plurality of outlet apertures 338 bonded to the inlet plate 307 of the partial jet stack 302, wherein the second plurality of outlet apertures 338 are substantially aligned with the first plurality of outlet apertures 308. The ink jet print head 300 can also include a circuit board 340 including a plurality of vias 342, a plurality of contact pads 344, and a plurality of electrical connections 345 bonded to the piezoelectric array 315 with a standoff layer 346, wherein the standoff layer 346 provides a fluid seal between the circuit board 340 and the plurality of port holes 306. The ink jet print head 300 can further include an ink manifold 350, wherein each of the plurality of vias 342 and each of the plurality of port holes 306, 366 can provide an individual inlet connecting the ink manifold 350 with each of the second plurality of outlet apertures 338.

According to various embodiments, there is a printing apparatus (not shown). The printing apparatus can include a partial jet stack 102 including a diaphragm 104 having an ink outlet side 109, a body plate 105 disposed under the ink outlet side 109 of the diaphragm 104, and an inlet plate 107 including a plurality of inlet channels 103 and a first plurality of outlet apertures 108 disposed under the body plate 105, wherein the diaphragm 104 includes a plurality of port holes 106. The printing apparatus can also include a piezoelectric array 115 including a plurality of piezoelectric elements 114 disposed in a planarized polymer 117 bonded to a side opposite to the ink outlet side 109 of the diaphragm 104 such that the planarized polymer 117 covers the plurality of port holes 106 and an aperture plate 130 including a second plurality of outlet apertures 138 bonded to the inlet plate 107 of the partial jet stack 102, wherein the second plurality of outlet apertures 138 are substantially aligned with the first plurality of outlet apertures 108. The printing apparatus can further include a circuit board 140 including a plurality of vias 142 and a plurality of contact pads 144 bonded to the piezoelectric array 115 with a standoff layer 146, wherein the standoff layer 146 provides a fluid seal between the circuit board 140 and the plurality of port holes 106 and an ink manifold 150, wherein each of the plurality of vias 142 and each of the plurality of port holes 106 provide an individual inlet connecting the ink manifold 150 with each of the second plurality of outlet apertures 138.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A jet stack comprising:

a partial jet stack comprising a diaphragm having an ink outlet side, a body plate disposed under the ink outlet side of the diaphragm, and an inlet plate comprising a plurality of inlet channels and a first plurality of outlet apertures disposed under the body plate, wherein the diaphragm comprises a plurality of port holes; and a piezoelectric array comprising a plurality of piezoelectric elements disposed in a planarized polymer bonded to a side opposite to the ink outlet side of the diaphragm, wherein a hole extends each of the plurality of port holes through the planarized polymer.

2. The jet stack of claim 1, wherein the hole which extends each of the plurality of port holes through the planarized polymer is a laser ablated hole.

3. The jet stack of claim 2, wherein the laser ablated hole comprises a tapered cross section.

4. The jet stack of claim 1, wherein the planarized polymer is a material selected from the group consisting of thermoset and thermoplastic polymers.

5. The jet stack of claim 1, wherein the planarized a tensile modulus less than about 2 GPa at about 120° C.

6. The jet stack of claim 1 further comprising an aperture plate comprising a second plurality of outlet apertures bonded to the inlet plate of the partial jet stack, wherein the second plurality of outlet apertures are substantially aligned with the first plurality of outlet apertures.

7. An ink jet print head comprising:

a partial jet stack comprising a diaphragm having an ink outlet side, a body plate disposed under the ink outlet side of the diaphragm, and an inlet plate comprising a plurality of inlet channels and a first plurality of outlet apertures disposed under the body plate, wherein the diaphragm comprises a plurality of port holes;

a piezoelectric array comprising a plurality of piezoelectric elements disposed in a planarized polymer bonded to a side opposite to the ink outlet side of the diaphragm, wherein a hole extends each of the plurality of port holes through the planarized polymer;

an aperture plate comprising a second plurality of outlet apertures bonded to the inlet plate of the partial jet stack, wherein the second plurality of outlet apertures are substantially aligned with the first plurality of outlet apertures;

a circuit board comprising a plurality of vias and a plurality of contact pads bonded to the piezoelectric array with a standoff layer, wherein the standoff layer provides a fluid seal between the circuit board and the plurality of port holes; and an ink manifold, wherein each of the plurality of vias and each of the plurality of port holes provide an individual inlet connecting the ink manifold with each of the second plurality of outlet apertures.

8. The ink jet print head of claim 7, wherein the hole which extends each of the plurality of port holes through the planarized polymer is a laser ablated hole.

9. The ink jet print head of claim 7, wherein the planarized polymer has a tensile modulus less than about 2 GPa at about 120° C.

10. A printing apparatus comprising:

a partial jet stack comprising a diaphragm having an ink outlet side, a body plate disposed under the ink outlet side of the diaphragm, and an inlet plate comprising a plurality of inlet channels and a first plurality of outlet apertures disposed under the body plate, wherein the diaphragm comprises a plurality of port holes;

a piezoelectric array comprising a plurality of piezoelectric elements disposed in a planarized polymer bonded to a side opposite to the ink outlet side of the diaphragm, wherein a hole extends each of the plurality of port holes through the planarized polymer;

an aperture plate comprising a second plurality of outlet apertures bonded to the inlet plate of the partial jet stack, wherein the second plurality of outlet apertures are substantially aligned with the first plurality of outlet apertures;

a circuit board comprising a plurality of vias and a plurality of contact pads bonded to the piezoelectric array with a standoff layer, wherein the standoff layer provides a fluid seal between the circuit board and the plurality of port holes; and an ink manifold, wherein each of the plurality of vias and each of the plurality of port holes provide an individual inlet connecting the ink manifold with each of the second plurality of outlet apertures.

11. The printing apparatus of claim 10, wherein the hole which extends each of the plurality of port holes through the planarized polymer is a laser ablated hole.

12. The printing apparatus of claim 10, wherein the planarized polymer has a tensile modulus less than about 2 GPa at about 120° C.

13. A jet stack comprising:

a partial jet stack comprising a diaphragm having an ink outlet side, a body plate disposed under the ink outlet side of the diaphragm, and an inlet plate comprising a plurality of inlet channels and a first plurality of outlet apertures disposed under the body plate, wherein the diaphragm comprises a plurality of port holes; and a piezoelectric array comprising a plurality of piezoelectric elements disposed in a planarized polymer bonded to a side opposite to the ink outlet side of the diaphragm, wherein the planarized polymer has a tensile modulus less than about 2 GPa at about 120° C.

14. The jet stack of claim 13, wherein a laser ablated hole extends each of the plurality of port holes through the planarized polymer.

15. The jet stack of claim 14, wherein the laser ablated hole comprises a tapered cross section.

16. The jet stack of claim 13, wherein the planarized polymer is a material selected from the group consisting of thermoset and thermoplastic polymers.

17. The jet stack of claim 13 further comprising an aperture plate comprising a second plurality of outlet apertures bonded to the inlet plate of the partial jet stack, wherein the second plurality of outlet apertures are substantially aligned with the first plurality of outlet apertures.

* * * * *